US012578174B2

(12) United States Patent
Thuvander et al.

(10) Patent No.: US 12,578,174 B2
(45) Date of Patent: Mar. 17, 2026

(54) CURVE OF CONSTANT WIDTH PROJECTILE SYSTEM

(71) Applicant: BAE SYSTEMS BOFORS AB, Karlskoga (SE)

(72) Inventors: Fredrik Thuvander, Karlstad (SE); David Malmström, Kristinehamn (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 106 days.

(21) Appl. No.: 18/574,011

(22) PCT Filed: Jun. 25, 2022

(86) PCT No.: PCT/SE2022/050635
§ 371 (c)(1),
(2) Date: Dec. 23, 2023

(87) PCT Pub. No.: WO2023/277769
PCT Pub. Date: Jan. 5, 2023

(65) Prior Publication Data

US 2024/0310155 A1 Sep. 19, 2024

(30) Foreign Application Priority Data

Jul. 1, 2021 (SE) ..... 2100110-2

(51) Int. Cl.
*F42B 14/06* (2006.01)
*F42B 10/04* (2006.01)
*F42B 27/00* (2006.01)

(52) U.S. Cl.
CPC ..... *F42B 14/06* (2013.01); *F42B 10/04* (2013.01); *F42B 27/00* (2013.01)

(58) Field of Classification Search
CPC ..... F42B 14/06; F42B 14/061; F42B 14/062; F42B 12/02; F42B 30/02; F42B 30/08; F42B 10/26; F42B 30/04
See application file for complete search history.

(56) References Cited

U.S. PATENT DOCUMENTS 650,461 A * 5/1900 Haws ..... F41A 21/18 42/78
3,514,026 A * 5/1970 Dardick ..... F41A 9/46 968/359
3,643,364 A 2/1972 Koch
3,786,589 A 1/1974 Kaltmann
4,142,467 A 3/1979 Stahlmann et al.
(Continued)

FOREIGN PATENT DOCUMENTS

AT 510040 A4 1/2012
DE 3920254 A1 * 1/1991 ..... F42B 14/061
(Continued)

OTHER PUBLICATIONS

International Search Report (Sep. 15, 2022) for corresponding International App. PCT/SE2022/050635.
(Continued)

*Primary Examiner* — Jonathan C Weber
(74) *Attorney, Agent, or Firm* — Husch Blackwell LLC

(57) ABSTRACT

A projectile for launching from a launching device with a propellant charge in a barrel is arranged with a cross-section in the shape of a curve of constant width.

8 Claims, 8 Drawing Sheets

(56) References Cited

U.S. PATENT DOCUMENTS

| | | | | | |
|---|---|---|---|---|---|
| 5,025,731 | A * | 6/1991 | Meyer | F42B 14/061 102/521 |
| 5,164,538 | A | 11/1992 | Mcclain, III | |
| 6,234,082 | B1 | 5/2001 | Cros et al. | |
| 8,069,791 | B1 | 12/2011 | Kunstmann et al. | |
| 11,371,818 | B2 * | 6/2022 | Paterson | F42B 14/068 |
| 2021/0348901 | A1 * | 11/2021 | Paterson | F42B 14/068 |

FOREIGN PATENT DOCUMENTS

| | | | | |
|---|---|---|---|---|
| DE | 3940969 | A1 | 6/1991 | |
| EP | 0319877 | A2 | 6/1989 | |
| EP | 0403730 | A2 * | 12/1990 | F42B 14/061 |
| EP | 0768509 | A2 | 4/1997 | |
| EP | 3742103 | A1 | 11/2020 | |
| GB | 1591226 | A | 6/1981 | |
| WO | WO-2020089588 | A1 * | 5/2020 | F42B 14/061 |

OTHER PUBLICATIONS

Carlsson, Torgny "Verkstadsmatteknik", Boras 1999,; pp. 183-185; figures 16,17.

Reuleaux Triangle [online] Wolfram MathWorld [retrieved onSep. 15, 2022] Retrieved from the internet : https://mathworld.wolfram.com/ReuleauxTriangle.html. Available online at least since Aug. 17, 2000 according to archive.org (https://web.archive.org/web/20170830041005/mathworld.wolfr am.com/ReuleauxTriangle.html; pp. 1-3; all figures.

European Search Report (Apr. 8, 2025) for corresponding European App. EP 22 83 3761.

* cited by examiner

CURVE OF CONSTANT WIDTH PROJECTILE SYSTEM

BACKGROUND AND SUMMARY

The present invention relates to a projectile for launching in a launching device with a propellant charge in a barrel where the projectile is arranged with a cross-section in the form of a curve of constant width.

In conventional barrel-based weapon systems, the barrel cross-section of the barrel is rotationally symmetrically circular, and designed with or without rifling and adapted to be arranged in a similarly rotationally symmetrical and circular projectile. Fire tubes designed with rifling preferably designed with a pitch over the spread of the fire tube, which means that the projectile is rotated during the firing process. Rotation of the projectile is desirable to provide a rotation stabilized projectile, i.e. the projectile rotates, after the projectile has left the barrel. As an alternative to a rotation-stabilized projectile, the projectile can be stabilized by means of, for example, fins. In such cases, it may be preferable for the projectile not to rotate when it leaves the barrel. Thus, in such cases, the projectile can be outfitted with a sliding belt, which causes the projectile to either not rotate or only partially rotate during the projectile's launch phase when the projectile is fired in a rifled barrel. When the projectile leaves the barrel in this case, the projectile is stabilized by fins arranged on the projectile. As an alternative, the projectile can be fired from a barrel without rifling, also called smooth-bore, which results in no rotational force being transmitted to the projectile during the firing process.

U.S. Pat. No. 671,877 describes a projectile designed with an elliptical cross-section with a pitch in the barrel, which means that the projectile is rotated during the firing process without the use of rifling in the barrel. The patent document does not show a cross-section adapted for requirements regarding manufacturing technology, materials, strength or adaptation to projectiles for areas of use other than fine caliber.

Patent document AT 510 040 B1 describes a projectile designed with a flat design to provide a bearing surface for the projectile. The patent document does not show a cross-section adapted for requirements regarding manufacturing technology, strength or adaptation in order to be able to fire off rotation-stabilized projectiles.

According to an aspect of the present invention a projectile for launching in a launching device with a propellant charge in a barrel is provided where the projectile is arranged with a cross-section in the form of a curve of constant width.

According to additional aspects of a projectile according to the invention, the following applies:

the curve of constant width is defined by the expression $$r(\varphi) = \frac{D}{2} + \frac{C}{2}\sin(n\varphi),$$

where D is the core diameter, C is the rotation diameter, φ is an angle and n is an odd integer.

that n is 3.

that the projectile is a sabot projectile comprising a grenade.

that the sabot projectile consists of or comprises support bodies arranged, in whole or in part, so as to envelope a grenade.

that sabot projectile consists of or comprises a sabot and support elements arranged affixed to a grenade.

that the sabot and support elements are slidably arranged against the grenade to fire fin-stabilized grenades/projectiles.

that the projectile is a projectile with a curve of constant width.

that the projectile is designed with a pitch corresponding to the pitch of the barrel over the axial extent of the projectile with a curve of constant width, where the barrel is arranged on the launching device from which the projectile with a curve of constant width is intended to be fired.

BRIEF DESCRIPTION OF THE DRAWINGS

The invention will be described below by reference to the figures that are included there.

DETAILED DESCRIPTION

Figure 1:
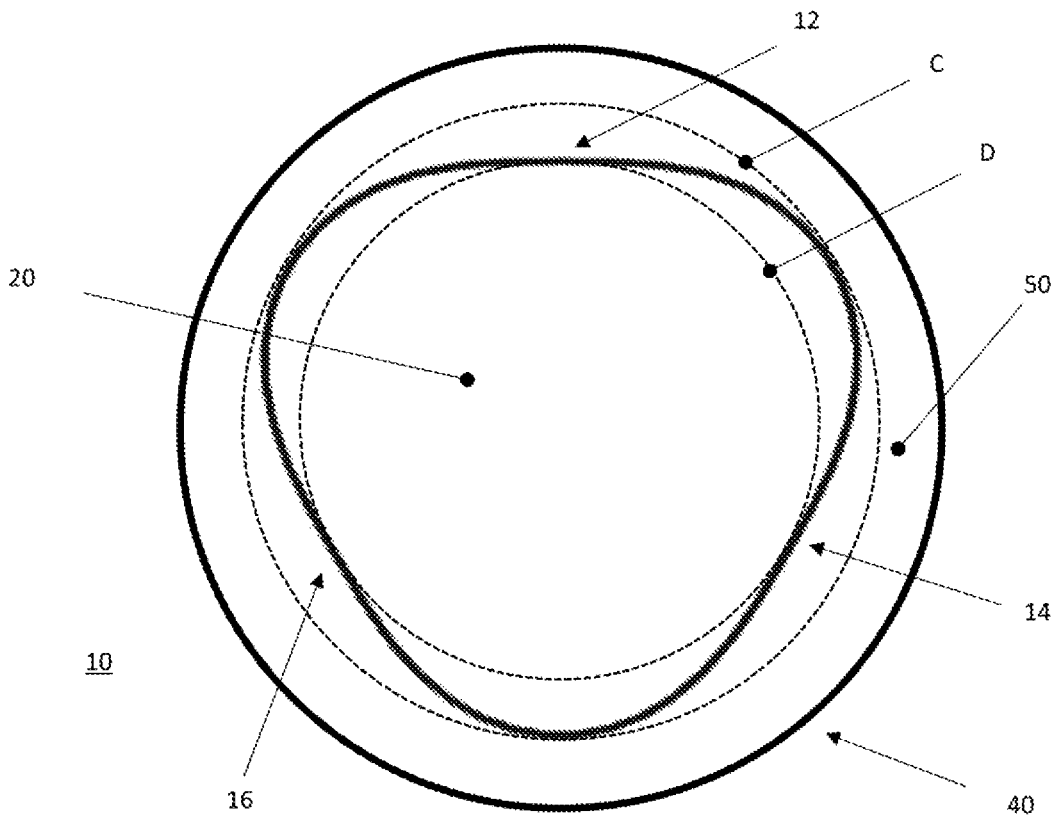
FIG. 1 shows a barrel in a view from the short side according to one embodiment of the invention.

The present invention points to a new and alternative design of a projectile intended for barrel-based launchers. An ejection device, also termed a cannon, a howitzer or a piece, in the sense of an artillery piece, has the goal of making use a propellant for the purpose of firing a projectile. Preferably, a propellant, such as gunpowder, is initiated in one part of the cannon, oftentimes a chamber specifically adapted to the purpose. Initiation takes place by way of igniting the propellant, for instance by means of an ignition cartridge or an igniter in an ammunitions device, which is initiated by means of striking. Other methods for igniting the propellant may include ignition of the propellant by means of laser energy or electric energy. The propellant burns at a high rate and results in large amounts of gas being produced, which creates a gas pressure in the chamber which propels the projectile out of the barrel of the firing ejection device. The propellant has been adapted in order to generate a constant pressure on the projectile during the entire barrel procedure, to the greatest extent possible, as the projectile moves in the barrel, which results in the projectile leaving the mouth of the barrel with high speed.

Projectiles, such as various types of grenades, generally include some form of operational part and some form of barrel which initiates the operational part. Barrels can be of different types where contact fuzes are common for projectiles that are meant to burst when in contact with an object, time fuzes when the projectile is meant to burst at a certain predetermined time and proximity fuzes when the projectile is meant to burst when an object comes within a certain distance from the projectile. The use of zone barrels is preferred when confronting flying vessels, while timed barrels can be used when confronting a large number of various objects. It is advantageous to combine various types of barrel functions in one and the same barrel, for instance in order for the projectile to burst after a certain time if it fails to detect any object, and so on.

It is advantageous for the operational part to comprise some type of explosive substance, as well as some type of shattering casing which encloses the explosive substance. Various types of propellants, such as fins, can furthermore be arranged in either the barrel or in its own subcomponent.

In order to stabilize the projectiles after the projectiles have left the barrel, the projectiles are preferably designed with rotation or with fins. In cases where the projectiles are designed with rotation, the projectiles are said to be rotationally stabilized and in cases where the projectiles are arranged with fins, the projectiles are said to be fin-stabilized. Fin-stabilized projectiles should have no rotation, or very low rotation, when leaving the barrel.

To achieve rotation on the projectiles, the barrel is often designed with rifling, to which the projectile connects during the firing process. Rifling means that the barrel in a firearm, the barrel, is provided with spiral-shaped rifling. The opposite is smooth-bore barrel. When the rifling engages the projectile during firing, it rotates along its longitudinal axis. Due to the rotation, minor irregularities or damage to the projectile will not cause a drift. Rotation is also necessary for an elongated (torpedo-shaped) projectile to maintain its direction after leaving the barrel and not start tumbling around. This is referred to as the projectile being rotation-stabilized. In smooth-bore weapons, only round (spherical) projectiles or fin-stabilized projectiles can be fired. An elongated projectile without fins will tumble as it leaves the muzzle.

Thus, rifling consists of or comprises grooves that are integrated into the track of the barrel, and the elevation in between is referred to as barriers. The rifling of fine-caliber firearms usually consists of or comprises four grooves that are turned to the right, while cannons, such as artillery pieces, have more grooves depending on the caliber of the launching device. In order for the rifling to be able to engage the projectile, the projectile must either be slightly larger than the diameter between the barriers, which is common for fine-caliber weapons, or be equipped with a special flange, called a belt, which has a slightly larger diameter than the barriers, which is common in projectiles with a diameter greater than 20 mm. The belt can be made out of plastic, composite material or a soft metal, such as brass. The length of the barrel on which the groove rotates an entire revolution is called pitch and is usually the number of inches per revolution. A pitch of 1:10 inches means that the projectile rotates a revolution of 10 inches. The corresponding pitch in millimeters is written 1:254 mm. The pitch is adjusted so that the projectile obtains the initial rotational speed required for it to maintain the required stability throughout its trajectory from launch to target, i.e. without losing its stability and starting to tumble around.

Most barrels include rifling, and, by arranging projectiles with sliding belts, both rotation-stabilized and fin-stabilized projectiles can be launched with rifled barrels. Smooth-bore barrels are basically only used for weapon systems intended to armored combat vehicles, as the rotation of the projectile means that the directed explosive action, RSV, is less effective since the centrifugal force causes the beam from RSV to be spread out.

Rifled barrels suffer from problems when it comes to the connection between the belt and barrel. On the one hand, gunpowder gases can pass the projectile in cases where the coupling is not completely sealed, which results in a lower firing rate, and on the other hand, the coupling causes wear on the barrel, which shortens the life of the barrel.

By changing the barrel geometry, and thus the projectile geometry, from being a fully circularly symmetrical design, a connection to the projectile can be achieved without the use of rifling in the barrel. Preferably, geometry called a curve of constant width is used, which is a geometric shape that is not circular, and which has a diameter, the distance between two parallel lines arranged on either side of the geometric shape, which is identical regardless of location on the geometry.

Each curve of constant width is a convex set. A convex set is a set in a real or complex vector space if each point along a distance between two arbitrarily selected points in the set is also in the set. It can also be expressed as all other points being on a line of sight from each point in the set. The outer radius of a curve of constant width is crossed no more than twice for each continuous line. Barbier's theorem also states that the circumference of a curve of constant width is given in the same way as the circumference of a circle, i.e. pi times the diameter. However, the area of a curve of constant width varies based on the geometry of the curve of constant width. Each curve of constant width includes points between which there is a longer distance than the diameter of the curve of constant width.

A curve of constant width can be defined by the expression:

$$r(\varphi) = \frac{D}{2} + \frac{C}{2}\sin(n\varphi) \quad [1]$$

Where n is an odd integer that is 3 or greater, D is the core diameter, C is the rotation diameter and φ is an angle that spans the curve of constant width across the angular range of 0-2 pi.

By arranging projectiles with a cross-section in the form of a curve of constant width, barrels with a cross-section in the form of a curve of constant width can be used to fire projectiles with a cross-section having the form of a curve of constant width.

A launching device is provided for firing, firing, projectiles with a propellant charge. The propellant charge, which can be gunpowder, for example, burns after initialization and generates a high pressure that drives the projectile out of a barrel. The projectile is arranged in the barrel by a method called hiring, it is common for a belt enclosing the projectile to be deformed relative to a groove arranged in the barrel which retains the projectile in the barrel. The propellant charge is arranged in what is often called a chamber in which the propellant charge is combusted during the generation of gases, gunpowder gases, which cause the projectile to move in the barrel. Preferably, a continuous/constant pressure is created in the chamber which also fills the barrel with pressurized gas behind the projectile as it moves towards the mouth of the barrel.

Problems with firing projectiles arranged with a belt included the belt causing wear on the barrel as we as the seal between the projectile and the barrel loosening, thus enabling the entry of gunpowder gases, which affects the launch process, among other things by the fact that it results in the projectile launch speed, V0, varying between different projectiles depending on differences in the seal between the projectile and the barrel.

The pitch of the rotation in the barrel corresponds to the rifling of a conventional rifled barrel and is the distance to a full turn of the rotation expressed as 1 turn in 10 inches" (1:10 inches) or expressed in metric dimensions as 1 turn in 254 mm" (1:254 mm)). A shorter distance means a faster rotation, which means that for a given launch speed, the projectile will rotate at a higher rotational speed. The combination of projectile length, weight, and design determines the rotational speed required to stabilize the projectile. In general, short projectiles with a high diameter (coarse caliber) require a lower rotational speed compared to long projectiles with a small diameter (fine caliber).

Barrels can also be manufactured with progressively increasing pitch. Extremely long projectiles, such as dart ammunition, also called flechettes, can be difficult to rotationally stabilize, which is why they are instead preferably fin-stabilized.

For best performance, the barrel should have a pitch that is high enough for the projectile to have such a high rotational speed that the projectile is rotationally stabilized, but the pitch should not be so large that the rotational speed is much higher than is required to achieve rotational stabilization. Coarser projectiles lead to better stabilization when a higher momentum is achieved, while elongated projectiles have an aerodynamic pressure point with leverage, which results in lower stability.

An alternative expression for the pitch is:

$$\text{Pitch} = \frac{L}{D_{cross-section}} \quad [2]$$

Where Pitch is rotation expressed in caliber, L is the length of the barrel needed to achieve a full lap of rotation, Dcross-section is the caliber, or the inner diameter of the barrel.

By designing the barrel with a cross-section in the form of a curve of constant width which is rotated with a pitch of between 20-30, the barrel can be designed with smooth walls and rotation of the projectile can be achieved by pitch, the rotation of the barrel cross-section over the axial distribution of the barrel, causes rotation on a projectile traveling through the barrel. The projectiles can be shaped with a cross-section corresponding to the cross-section of the barrel but with a size slightly below the size of the barrel to be able to fit into the barrel and thus be able to be fired from the barrel. The projectiles can also be of another cross-section, for example a circular cross-section, and are fired with a sabot arranged with a cross-section in the form of a curve of constant width. The sabot can be in the form of a sabot arranged around the projectile or in other ways arranged to enable a projectile to be fired into a barrel with a cross-section in the form of a curve of constant width.

FIG. 1 shows the barrel 10 seen from the short side, the radial part of the barrel, with a barrel opening 20 formed as a curve of constant width formed by three circular segments 12, 14 and 16. In the embodiment shown, the barrel 10 has a circular outer radius 40, but can also be of a different geometric shape and be adapted on the basis of, for example, advantages related to the manufacturing techniques. In an alternative embodiment, the outer radius is also in the form of a curve of constant width, which means that the wall thickness is equal over the radial distribution of the barrel. The barrel is designed with a certain wall thickness 50 and the geometry of the barrel opening cross section 20 is machined in the barrel by conventional machining methods such as, for example, various forms of cutting machining including reaming. The cross section 20 for the geometry of the barrel opening can also be called the course of the barrel. The barrel 10 can also be manufactured by additive manufacturing methods. FIG. 1 also shows the rotation diameter C, which is the diameter which the curve of constant width creates when it has an supposed rotation, or the circle which encloses the curve of constant width. FIG. 1 also shows a circle with the diameter core diameter D, which is the diameter of a circle enclosed by the curve of constant width. The rotation diameter C and the core diameter D are two supposed diameters used in the formula for the curve of constant width.

Figure 2:
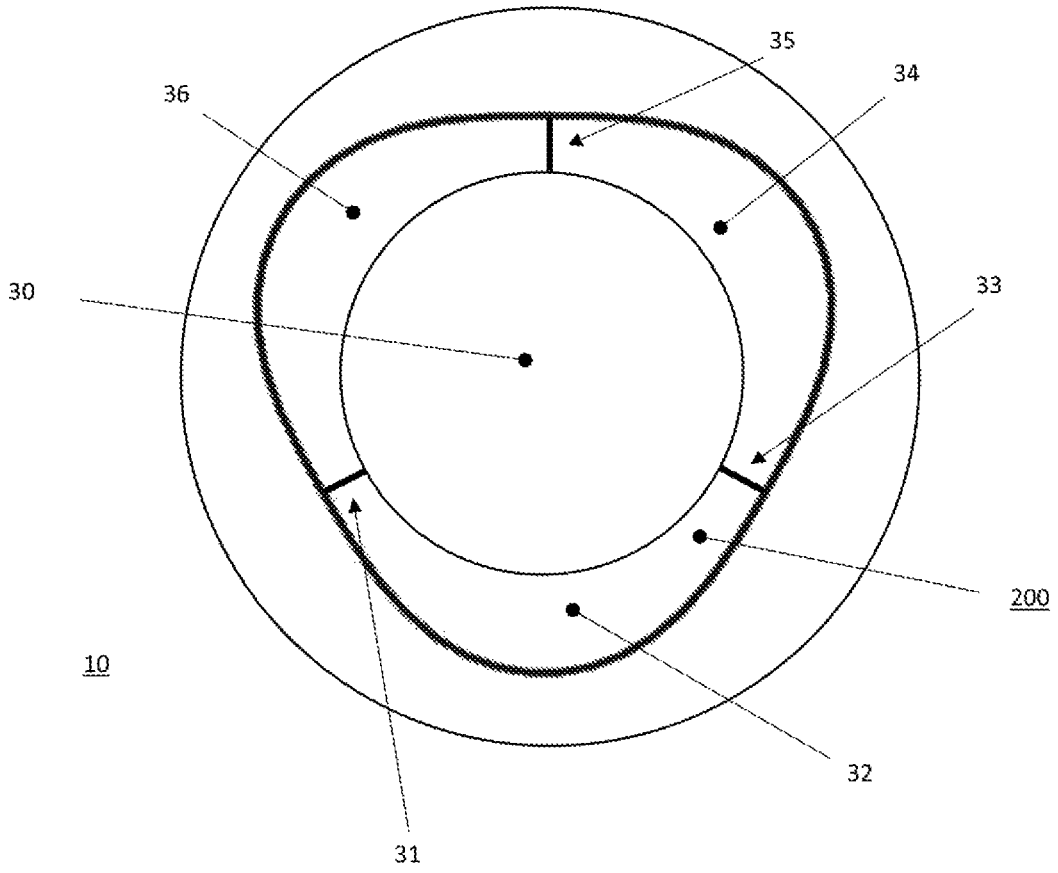
FIG. 2 shows a barrel loaded with a grenade in a view from the short side according to one embodiment of the invention.

FIG. 2 shows a circularly symmetrical grenade 30, also called a sub-caliber grenade, arranged with three support bodies 32, 34, 36, also called a sabot. Gaps 31, 33, 35 arise between the support bodies, which are preferably arranged so that the gaps do not cause gunpowder gases to pass through the grenade, for example by arranging a seal between the support bodies or by the surfaces of the support bodies being designed with high tolerance. The support bodies 32, 34, 36 are arranged to be separated from the grenade 30 after the grenade 30 leaves the barrel, i.e. passes out through the mouth of the barrel. The combination of the support bodies and the grenade can be called a sabot projectile 200. The sabot projectile 200 will, once the sabot projectile 200 has left the barrel, be divided into separate support bodies 32, 34, 36, which will tumble and fall to the ground, and into grenades 30 which travel in a rotationally stabilized manner towards the target object. The support bodies 32, 34, 36 are thus only intended to convey the grenade 30 through the barrel. The support bodies are thus made of a material which can withstand the strength of the barrel and is easy to process but is also inexpensive, such as plastic or aluminum. If applicable, the support bodies can also be reused or recycled after launching. The support bodies 32, 34, 36 can be arranged over the entire longitudinal extent of the grenade 30 or only on a part of the longitudinal extent of the grenade or even divided to be distributed at several points over the longitudinal extent of the grenade.

Figure 3:
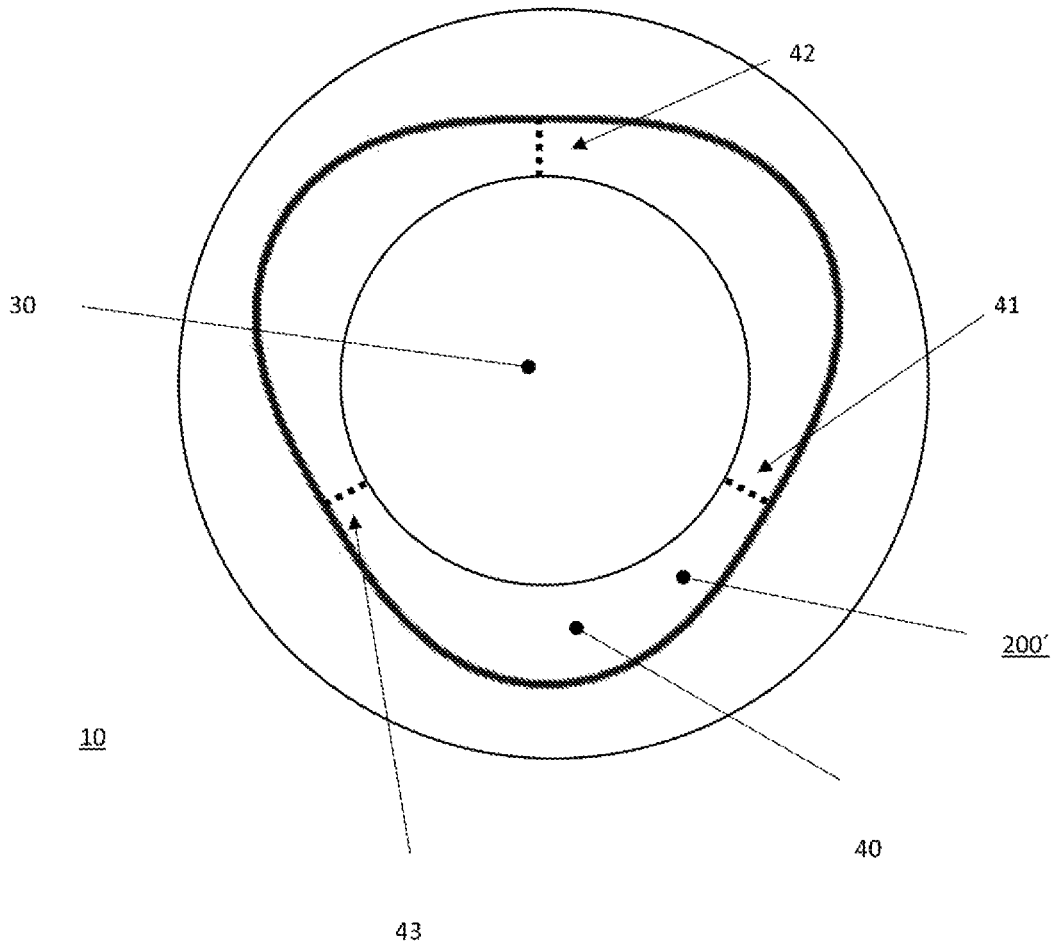
FIG. 3 shows a barrel loaded with a grenade in a view from the short side according to an alternative embodiment of the invention.

FIG. 3 shows a circularly symmetrical grenade 30, also called a sub-caliber grenade, arranged with a sabot 40 and support elements 41, 42, 43. The sabot and the support elements 41, 42, 43 are arranged to be separated from the grenade 30 after the grenade 30 leaves the barrel, i.e. passes out through the mouth of the barrel. The combination of sabot 40, support elements 41, 42, 43 and grenade 30 can be called a sabot projectile 200'. The sabot projectile 200 will, once the sabot projectile 200 has left the barrel, be divided into separate sabot 40 and support elements 41, 42, 43 which will tumble and fall to the ground, and into grenades 30 which travel in a rotationally stabilized manner towards the target object. The sabot 40 and support elements 41, 42, 43 are thus only intended to convey the grenade 30 through the barrel. The sabot 40 and support elements 41, 42, 43 are thus made of a material which can withstand the strength of the barrel and is easy to process but is also inexpensive, such as plastic or aluminum. If applicable, the sabot 40 and support elements 41, 42, 3 can also be reused or recycled after launching. The sabot 40 is arranged behind grenade 30 or with a central socket for grenade 30. The support elements 41, 42, 43 can be arranged over the entire longitudinal extent of the grenade 30 or only on a part of the longitudinal extent of the grenade or even divided to be distributed at several points over the longitudinal extent of the grenade.

Sabot can be designed as a cup sabot, where the grenade is arranged in a holder, cup, as an expanding cup sabot, where the grenade is arranged in a holder, cup, which expands and thus is reduced in speed after the grenade has left the barrel, as a base sabot, where the grenade is arranged with a sabot as a base, or as a spindle sabot, where the sabot is often made of, for example, sheet metal and has an expanding function during the launch process.

Figure 4:
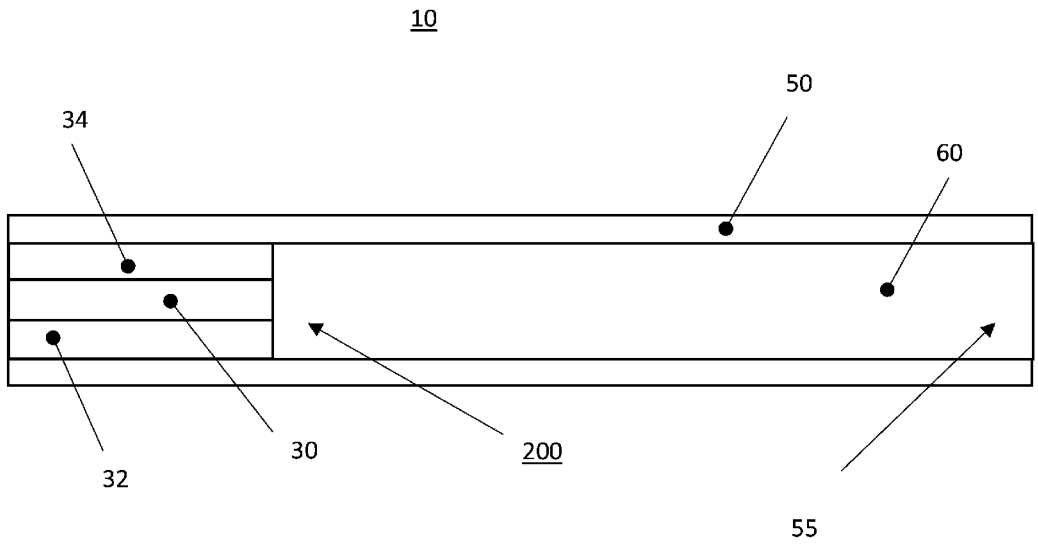
FIG. 4 shows a barrel loaded with a grenade in a view from the long side according to a first embodiment of the invention.

FIG. 4 shows an embodiment of a sabot projectile 200 seen from a cross-section of the barrel 10 in the longitudinal direction of the barrel. The support bodies continue along the axial extent of the grenade 30 and carry the grenade 30, or are arranged between the grenade 30 and the barrel 10, over the entire extent of the grenade 30. Two of the support bodies 32, 34 can be seen in the figure, which is shown as a cross-section. The grenade moves in the barrel 60 when propellant is initiated and drives the sabot projectile 200 through the barrel. The barrel has a certain wall thickness 50 and an orifice 55 where the sabot projectile leaves the barrel 10.

Figure 5:
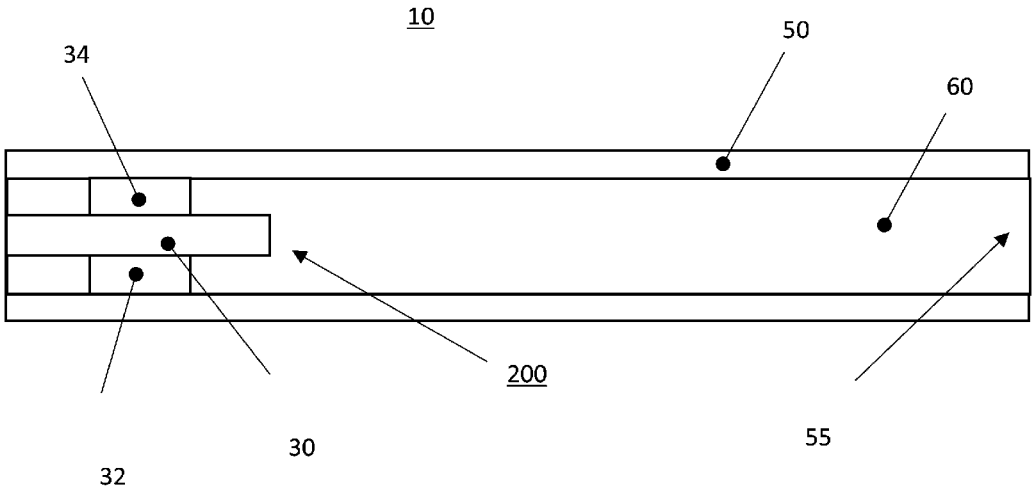
FIG. 5 shows a barrel loaded with a grenade in a view from the long side according to a second embodiment of the invention.

FIG. 5 shows an embodiment of a sabot projectile 200 seen from a cross-section of the barrel 10 in the longitudinal direction of the barrel. The support bodies are arranged on a point along the axial extent of the grenade 30 and carry the grenade 30, or are arranged between the grenade 30 and the barrel 10, over a part of the extent of the grenade 30. Two of the support bodies 32, 34 can be seen in the figure, which is shown as a cross-section. The grenade moves in the barrel 60 when propellant is initiated and drives the sabot projectile 200 through the barrel. The barrel has a certain wall thickness 50 and an orifice 55 where the sabot projectile 200 leaves the barrel 10.

Figure 6:
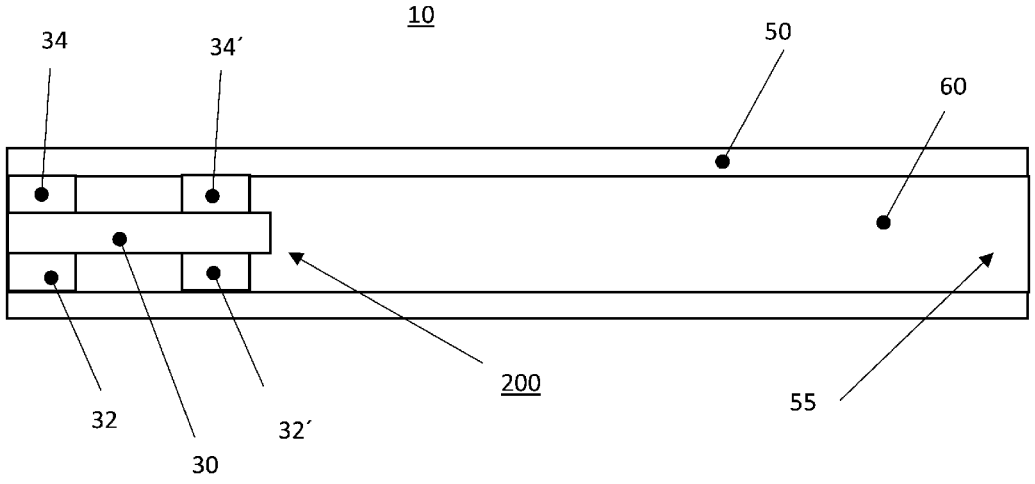
FIG. 6 shows a barrel loaded with a grenade in a view from the long side according to a third embodiment of the invention.

FIG. 6 shows an embodiment of a sabot projectile 200 seen from a cross-section of the barrel 10 in the longitudinal direction of the barrel. The support bodies are arranged on several points along the axial extent of the grenade 30 and carry the grenade 30, or are arranged between the grenade 30 and the barrel 10, over several points of the extent of the grenade 30. Two of the support bodies 32, 32, 32, 34 can be seen in the figure, which is shown as a cross-section. The grenade moves in the barrel 60 when propellant is initiated and drives the sabot projectile 200 through the barrel. The barrel has a certain wall thickness 50 and an orifice 55 where the sabot projectile 200 leaves the barrel 10.

Figure 7:
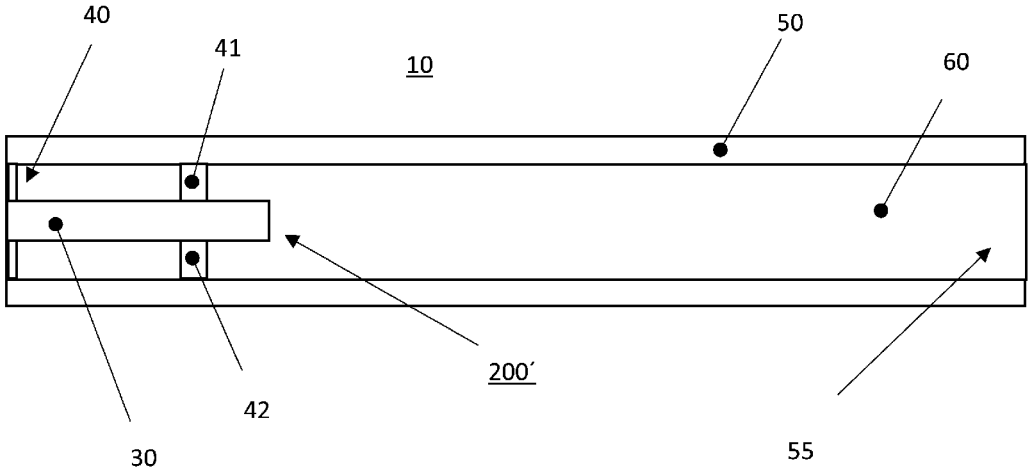
FIG. 7 shows a barrel loaded with a grenade in a view from the long side according to a fourth embodiment of the invention.

FIG. 7 shows an embodiment of a sabot projectile 200' seen from a cross-section of the barrel 10 in the longitudinal direction of the barrel. The figure shows a circularly symmetrical grenade 30, also called a sub-caliber grenade, arranged with a sabot 40 and two of support elements 41, 42. The sabot 200', and thus the grenade 30, move in the barrel 60 when propellant is initiated and drives the sabot projectile through the barrel. The barrel has a certain wall thickness 50 and an orifice 55 where the sabot projectile 200' leaves the barrel 10 whereupon the sabot 40 and the support elements 41, 42 leave the grenade 30 and fall to the ground while the rotation stabilized or fin-stabilized grenade continues its path towards a target object.

Figure 8A:
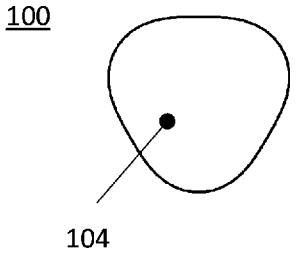
FIG. 8*a* shows a projectile with a curve of constant width in a view from the short side according to one embodiment of the invention.

FIG. 8*a* shows a projectile with a curve of constant width 100 from the short side where the projectile is arranged as a composite projectile without sabot. The cross-section of the projectile 104 has the form of a curve of constant width.

Figure 8B:
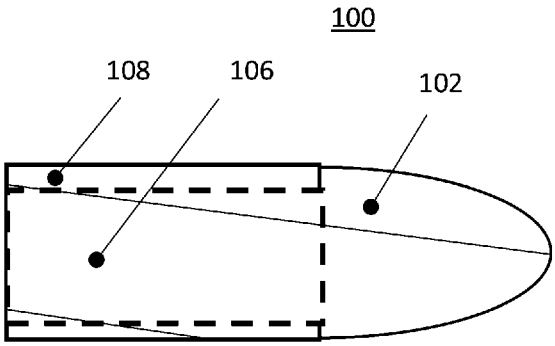
FIG. 8*b* shows a projectile with a curve of constant width in a view from the long side according to one embodiment of the invention.

FIG. 8*b* shows a projectile with a curve of constant width 100 from the long side where the projectile is arranged as a composite projectile without sabot. The projectile is arranged with a nose which may be a barrel 102 which is arranged to a projectile or a barrel which is directly machined on the projectile with a curve of constant width. The barrel 102 may be a conventional circularly symmetrical barrel or a barrel adapted to the projectile with a curve of constant width and thus arranged with a cross section, in whole or in part, in the form of a curve of constant width. In one embodiment, the projectile with a curve of constant width is provided with energetic material 106 with a surrounding shatter-acting housing 108, but it can also be designed in other ways. The projectile with a curve of constant width 100 is provided with a pitch corresponding to the pitch of the barrel, i.e. the radial design of the projectile with a curve of constant width changes across the axial joint of the projectile. The projectile with a curve of constant width is arranged in the barrel, and loaded by means of a combined axial and radial movement, causing the projectile to move in an axial direction into the barrel while the projectile is simultaneously rotated with the pitch in the barrel.

An example of caliber is 20-155 mm. With a sabot projectile, it becomes possible to fire all calibers between the largest caliber allowed by the barrel and all calibers that are smaller than said largest caliber, for a given barrel diameter.

The invention is not limited to the embodiments specifically shown, but can be varied in different ways within the framework of the claims.

For instance, it is clear that the number, size, material and shape of the elements included in the projectiles, as well as the details, are to be adapted according to the projectile(s) and projectile compositions, along with other construction-related properties, which are applicable to each individual case.

In the shown embodiment, n=3 but can also be other odd integers, such as 5, 7, 9, 11, and 13. An expression for n is that n=(2k+1), where k is an integer according to k= 1, 2, 3 . . . .

For instance, the projectile can be arranged so that it is capable of exploding, emitting shrapnel, catching fire, exerting a thermobaric effect, fighting fires, to be used as a training projectile, in light kits, in smoke kits, to exert electromagnetic effect, bring about electromagnetic disturbances or other loads and functions.

The invention claimed is:

1. A projectile launching system, comprising a projectile, a propellant charge, a barrel wherein the propellant charge and the projectile are arranged with a cross-section in shape of a curve of constant width, wherein the curve of constant width is defined by the expression $$r(\varphi) = \frac{D}{2} + \frac{C}{2}\sin(n\varphi),$$

where D is the core diameter, C is the rotation diameter, $\varphi$ is an angle and n is an odd integer, and wherein the barrel has an inner shape with a matching curve of constant width.

2. The projectile launching system according to claim 1, wherein n is 3.

3. The projectile launching system according to claim 1, wherein the projectile is a sabot projectile comprising a grenade arranged with a sabot with a cross-section in the form of a curve of constant width.

4. The projectile launching system according to claim 3, wherein the projectile is a sabot made up of support bodies arranged, either wholly or in part, so as the envelop a grenade.

5. The projectile launching system according to claim 3, wherein the sabot is made out of support elements affixed to a grenade.

6. The projectile launching system according to claim 5, wherein the sabot and the support elements are arranged against the grenade in a sliding fashion in order to fire off a fin-stabilized projectile.

7. The projectile launching system according to claim 1, wherein the projectile is a sabot projectile with a curve of constant width.

8. The projectile launching system according to claim 7, wherein the sabot projectile is designed with a projectile pitch corresponding to a pitch of the barrel across the radial extent of the projectile with a curve of constant width.

* * * * *